US008833912B2

(12) United States Patent
Olsen

(10) Patent No.: US 8,833,912 B2
(45) Date of Patent: Sep. 16, 2014

(54) REPLACEABLE PRINTING COMPONENT

(75) Inventor: David N. Olsen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 140 days.

(21) Appl. No.: 13/263,919

(22) PCT Filed: May 18, 2009

(86) PCT No.: PCT/US2009/044360

§ 371 (c)(1), (2), (4) Date: Oct. 11, 2011

(87) PCT Pub. No.: WO2010/134907

PCT Pub. Date: Nov. 25, 2010

(65) Prior Publication Data

US 2012/0062662 A1 Mar. 15, 2012

(51) Int. Cl.
*B41J 2/175* (2006.01)

(52) U.S. Cl.
CPC ..... *B41J 2/1752* (2013.01)
USPC ..... 347/86

(58) Field of Classification Search
USPC ..... 347/85, 86
See application file for complete search history.

(56) References Cited

U.S. PATENT DOCUMENTS

| | | | | |
|---|---|---|---|---|
| 4,907,019 | A | 3/1990 | Stephens | |
| 5,519,422 | A | 5/1996 | Thoman et al. | |
| 5,880,764 | A | 3/1999 | Barinaga | |
| 5,956,057 | A | 9/1999 | Childers et al. | |
| 6,017,118 | A | 1/2000 | Gasvoda et al. | |
| 6,151,041 | A | 11/2000 | Bolash et al. | |
| 6,276,788 | B1 | 8/2001 | Hilton | |
| 6,290,346 | B1 | 9/2001 | Santhanam et al. | |
| 6,293,662 | B1 * | 9/2001 | Shihoh et al. | 347/86 |
| 6,364,462 | B1 | 4/2002 | Furukawa et al. | |
| 6,375,315 | B1 | 4/2002 | Steinmetz et al. | |
| 6,431,697 | B1 | 8/2002 | King et al. | |
| 6,443,567 | B1 * | 9/2002 | Hayashi et al. | 347/85 |
| 6,471,333 | B1 | 10/2002 | Powell et al. | |
| 6,749,294 | B2 | 6/2004 | Haldorsen | |
| 6,938,997 | B2 | 9/2005 | Toba et al. | |
| 6,942,328 | B2 | 9/2005 | Haldorsen | |
| 6,945,642 | B2 * | 9/2005 | Yamamoto et al. | 347/86 |
| 6,962,408 | B2 | 11/2005 | Steinmetz et al. | |
| 7,192,129 | B2 | 3/2007 | Droege et al. | |
| 7,367,652 | B2 * | 5/2008 | Miyazawa et al. | 347/49 |

FOREIGN PATENT DOCUMENTS

| | | |
|---|---|---|
| JP | 08-300803 | 11/1996 |
| JP | 2000-127428 | 5/2000 |

OTHER PUBLICATIONS

PCT Search Report for PCT/US2009/044360 mailed Jan. 29, 2010 (5 pages).

* cited by examiner

*Primary Examiner* — Huan Tran

(57) ABSTRACT

A replaceable printing component includes a housing, and an array of pockets separated by ribs and each having a first geometrical shape formed in a side of the housing, wherein at least one of the ribs between adjacent ones of the pockets is removed to form a combined pocket having a second geometrical shape.

12 Claims, 6 Drawing Sheets

REPLACEABLE PRINTING COMPONENT

BACKGROUND

Inkjet printers typically utilize one or more printheads each including an array of orifices (or nozzles) through which ink is ejected onto paper or other printing media to form an image. The printheads may be supported by a moveable carriage that traverses back and forth across the width of the paper as the paper is fed through the printer during printing operations, or the printheads may remain stationary during printing operations, as in a page-wide array of printheads. The printheads may be an integral part of a print cartridge or may be a discrete assembly to which ink is supplied from a separate, and often replaceable, ink container. For printers that utilize replaceable ink containers, proper positioning of the replaceable ink containers in the printer may be provided by a keying arrangement.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Embodiments of the disclosure were developed in an effort to improve a keying arrangement between a carriage and a removable/replaceable ink container—to prevent wrongful or improper ink container insertion—using a relatively small area on the ink container yet allowing a large combination of keys. Wrongful or improper insertion of an ink container into the carriage may result in ink mixing, wrong color output, or ink crashing and permanent clogs that may ruin the printer. Embodiments of the disclosure, therefore, were developed to avoid or solve such problems.

Embodiments will be described, therefore, with reference to an inkjet printhead assembly that holds removable/replaceable ink containers. Embodiments of the disclosure, however, are not limited to such implementations. Embodiments of the disclosure, for example, might also be implemented in other types of ink or fluid dispensing components. The example embodiments shown in the Figures and described below, therefore, illustrate but do not limit the scope of the disclosure.

Embodiments of the disclosure use a series of pockets and walls or ribs to form unique combinations of two-dimensional keying. The use of pockets and ribs provides a strong structure so that features can be made relatively small and provide many combinations in a small area on the ink container while leaving room for other features such as fluid connections and acumen connections. The two-dimensional keying arrangement uses a technique of removing a specific combination of walls ribs between adjacent pockets of the ink container and forming corresponding towers or projections on a mating part of the printer to allow only a properly keyed ink container to be inserted into the printer.

Figure 1:
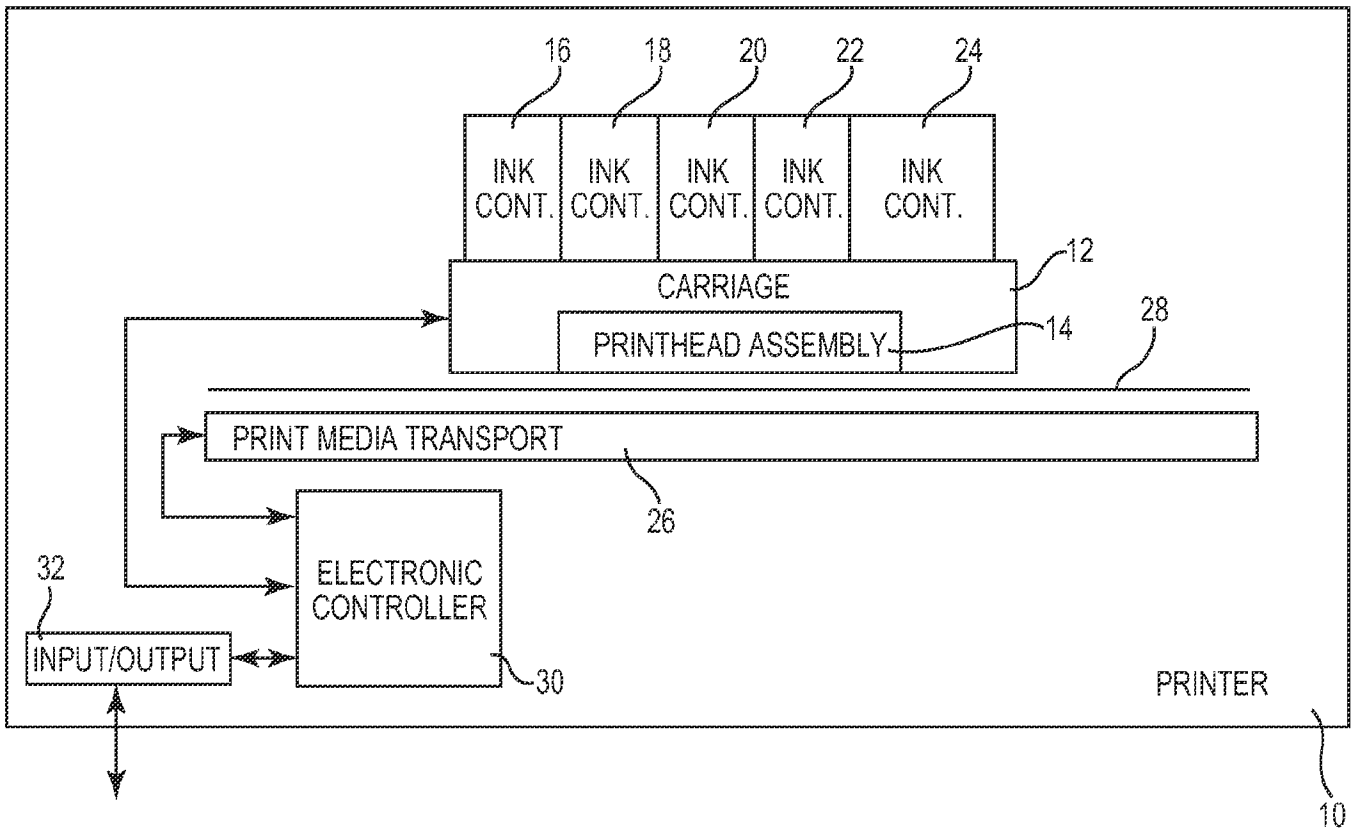
FIG. 1 is a block diagram illustrating one embodiment of an inkjet printer.

FIG. 1 is a block diagram illustrating one embodiment of an inkjet printer 10 in which embodiments of the disclosure may be implemented. Printer 10 includes a carriage 12 carrying or supporting a printhead assembly 14 and removable or replaceable ink containers 16, 18, 20, 22, and 24. Printhead assembly 14 forms part of a fluid ejection system for precisely dispensing a fluid, such as ink, as described in more detail below. Printhead assembly 14 includes a printhead (FIG. 3) through which ink from one or more containers 16-24 is ejected. In one embodiment, printhead assembly 14 includes two printheads—one for ejecting ink from a series of color ink containers 16-22 and one for ejecting ink from a black ink container 24. Printhead assembly 14 may include an array of miniature thermal, piezoelectric or other devices that are energized or activated to eject small droplets of ink out of an associated array of orifices (or nozzles). A typical thermal inkjet printhead, for example, includes an orifice plate arrayed with ink ejection orifices and firing resistors formed on an integrated circuit chip.

In one embodiment, a print media transport mechanism 26 advances print media 28 relative to carriage 12 and printhead assembly 14. For a stationary carriage 12, media transport 26 may advance media 28 continuously past carriage 12. For a movable, scanning carriage 12, media transport 26 may advance media 28 incrementally past carriage 12, stopping as each swath is printed and then advancing media 28 for printing the next swath.

In one embodiment, an electronic controller 30 is operatively connected to carriage 12, printhead assembly 14, and media transport 26. Controller 30 communicates with external devices through an input/output device 32 for exchanging data, including receiving print data for inkjet imaging. The presence of an input/output device 32, however, does not preclude the operation of printer 10 as a stand alone unit. In one embodiment, controller 30 controls the movement of carriage 12 and media transport 26. In addition, controller 30 is electrically connected to each printhead of printhead assembly 14 to selectively energize the firing resistors, for example, to eject ink drops onto media 28. By coordinating the relative position of carriage 12 with media 28 and the ejection of ink drops from printhead assembly 14, controller 30 produces the desired image on media 28.

Figure 2:
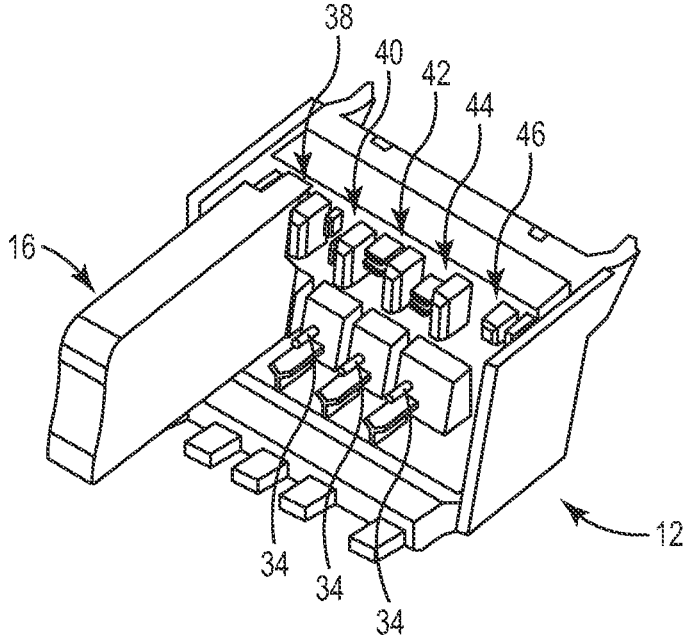
FIGS. 2 and 3 are top and bottom perspective views illustrating one embodiment of a carriage supporting an ink container.
Figure 3:
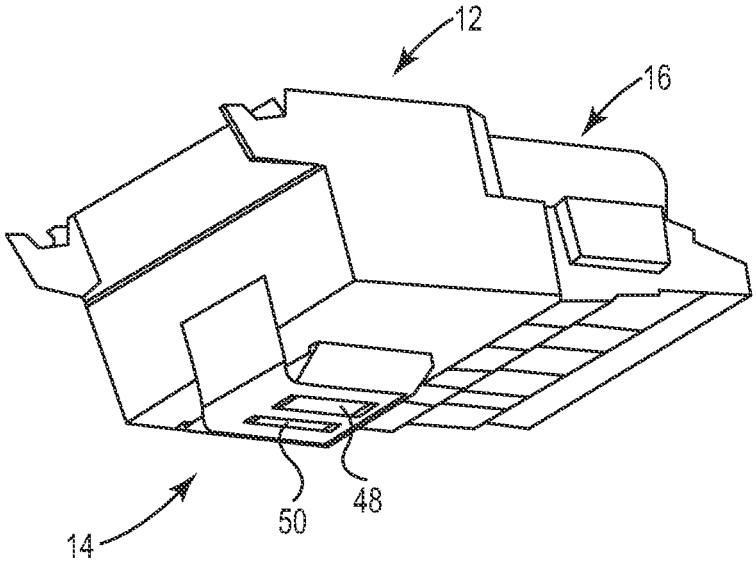

FIGS. 2 and 3 are perspective top and bottom views of one embodiment of carriage 12 and printhead assembly 14 of printer 10. Ink container 16 is positioned in carriage 12 and ink containers 18-24 (FIG. 1) are removed from carriage 12 to show inlets 34 to printhead assembly 14 and alignment features for ink containers 16-24. In the embodiment of FIG. 2, printhead assembly 14 includes an ink inlet 34 positioned at each bay 38, 40, 42, 44, and 46 for a corresponding ink container 16, 18, 20, 22, and 24. Printhead assembly 14 and carriage 12 may be integrated together to form a single component, or printhead assembly 14 may be detachable from carriage 12.

In the embodiment of FIG. 3, printhead assembly 14 includes two printheads 48 and 50. In one embodiment, each ink container 16-24 (FIG. 1) includes an ink outlet 36 (FIG. 4) through which ink may flow from ink containers 16-24 through the corresponding ink inlet 34 (FIG. 2) to a corresponding printhead 48 or 50 of printhead assembly 14. As such, ink from color ink containers 16-22, for example, is ejected from printhead 48 and ink from black ink container 24 is ejected from printhead 50.

Figure 4:
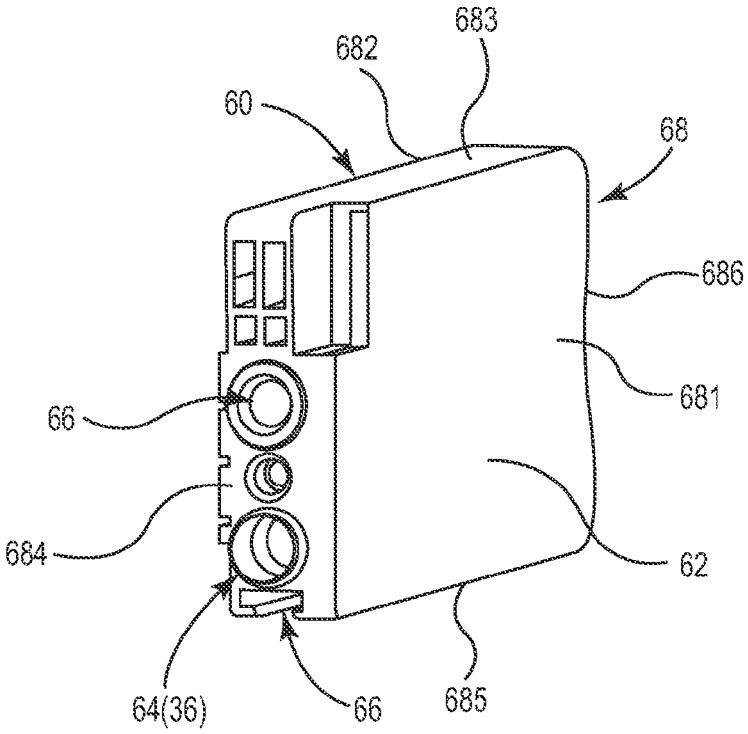
FIG. 4 is a perspective view illustrating one embodiment of an ink container.

FIG. 4 is a perspective view illustrating one embodiment of a printing fluid or ink container 60, such as one of ink containers 16, 18, 20, 22, and 24 (FIG. 1). Ink container 60, as one embodiment of a replaceable printing component, includes a body or housing 62 and a quantity of printing fluid or ink contained within housing 62. As such, ink within housing 62 is communicated with or supplied to printhead assembly 14 to facilitate printing by printer 10 (FIG. 1).

In one embodiment, ink container 60 includes a fluid interconnect 64 (as one embodiment of ink outlet 36) for supplying printing fluid or ink within ink container 60 to printhead assembly 14, and includes one or more alignment features 66 for positioning ink container 60 in carriage 12 (FIG. 2). In one embodiment, housing 62 has a rectangular shape 68 and includes opposite major surfaces 681 and 682, and sides 683, 684, 685, and 686 oriented substantially perpendicular to major surfaces 681 and 682. In one embodiment, fluid interconnect 64 and alignment features 66 are formed on or in or communicate with side 684 of housing 62. As such, in one embodiment, ink container 60 is inserted into carriage 12, for example, inserted into one of bays 38, 40, 42, 44, and 46 of carriage 12 (FIG. 2), in a direction substantially perpendicular to side 684 of housing 62.

Figure 5:
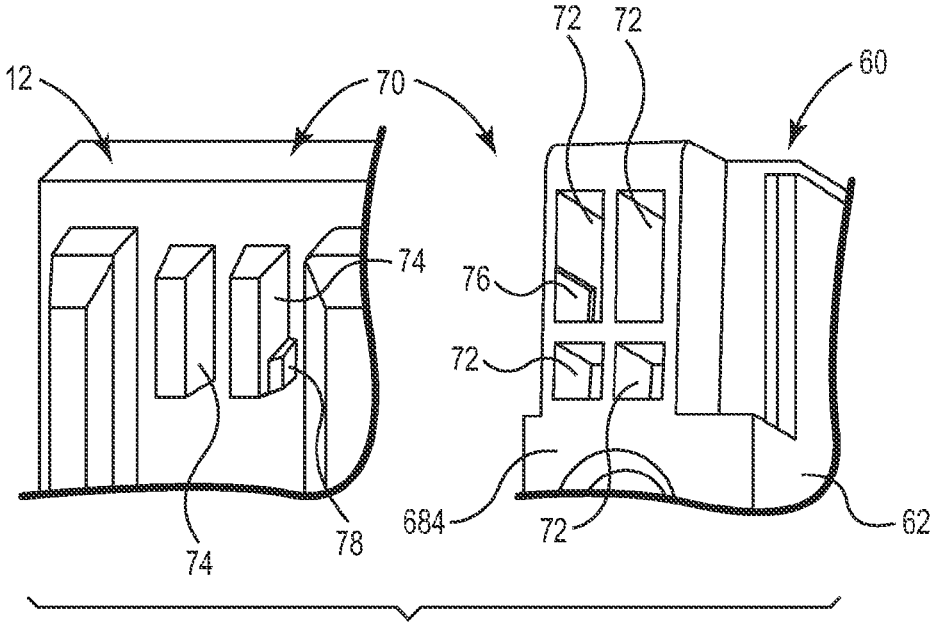
FIG. 5 is an enlarged partial view illustrating one embodiment of a keying arrangement between a carriage and the ink container of FIG. 4.

In one embodiment, as illustrated in FIGS. 4 and 5, ink container 60, in association with carriage 12, includes a keying arrangement 70. More specifically, ink container 60 and carriage 12 include a mating and corresponding method of keying ink container 60 to carriage 12 to prevent wrongful or improper insertion of ink container 60 into carriage 12. As described below, keying arrangement 70 provides a two-dimensional keying method using a specific combination of pockets 72 formed in ink container 60 and mating and corresponding posts or projections 74 formed on carriage 12 to allow only properly keyed ink containers to be inserted into carriage 12.

In one embodiment, pockets 72 are formed in side 684 of housing 62 and extend into housing 62 in a direction substantially perpendicular to side 684 of housing 62 such that projections 74 formed on carriage 12 are received and inserted in a direction substantially perpendicular to side 684 of housing 62 as ink container 60 is positioned in printer 10.

In one embodiment, as illustrated in FIG. 5, ink container 60 and carriage 12 include respective mating and corresponding datum features 76 and 78. Datums 76 and 78 establish reference points for locating and final positioning of ink container 60 in carriage 12 when ink container 60 is installed in carriage 12. More specifically, datums 76 and 78 establish relative positioning of ink container 60 in the x, y, and z directions when ink container 60 is installed in carriage 12. In one embodiment, datums 76 and 78 are formed in association with mating sections of keying arrangement 70 in that datum 76 is formed in one of pockets 72 of ink container 60, and datum 78 is formed on one of projections 74 of carriage 12. Datums 76 and 78, therefore, locate ink container 60 relative to carriage 12 when the mating sections of keying arrangement 70 interact.

Figure 6:
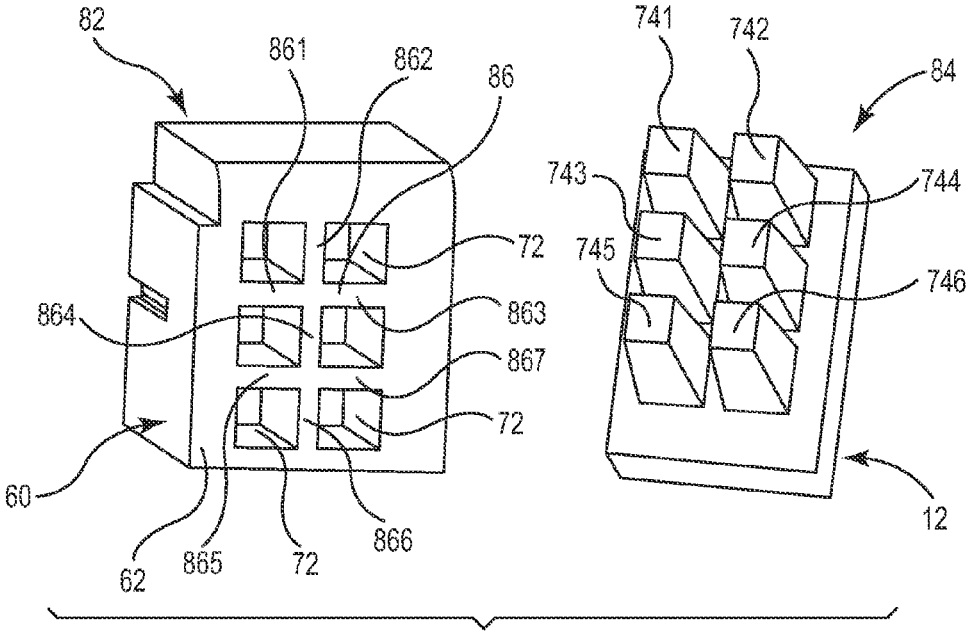
FIGS. 6 and 7 are schematic perspective views illustrating one embodiment of forming a keying arrangement between a carriage and an ink container.
Figure 7:
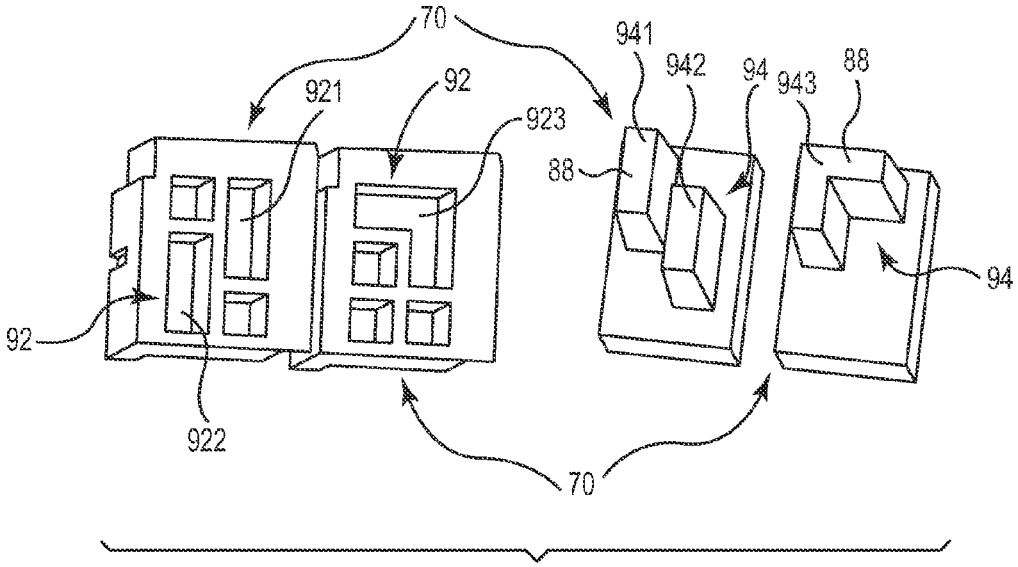

FIGS. 6 and 7 illustrate one embodiment of forming keying arrangement 70 including, more specifically, pockets 72 and projections 74 of keying arrangement 70. In one embodiment, as schematically illustrated in FIG. 6, an array 82 of pockets 72 is formed in housing 62 of ink container 60 (only a portion thereof being illustrated in FIG. 6), and an array 84 of projections 74 is formed on carriage 12 (only a portion thereof being illustrated in FIG. 6).

In one embodiment, array 82 of pockets 72 includes columns and rows of pockets 72 separated by walls or ribs 86 with each pocket 72 having the same geometrical shape. In one embodiment, array 82 includes a 2×3 array (i.e., 2 columns by 3 rows) of pockets 72. As such, in one embodiment, pockets 72 are separated by ribs 861, 862, 863, 864, 865, 866, and 867. It is understood that other sizes and/or configurations of arrays may be used.

In one embodiment, array 84 of projections 74 includes columns and rows of projections 74 each corresponding to and having the same geometrical shape as that of pockets 72 of array 82. Thus, in one embodiment, array 84 includes a 2×3 array (i.e., 2 columns by 3 rows) of projections 74 corresponding to the 2×3 array of pockets 72. As such, in one embodiment, projections 74 include projections 741, 742, 743, 744, 745, and 746. Again, it is understood that other sizes and/or configurations of arrays may be used.

In one embodiment, as illustrated in FIG. 7, keying arrangement 70 is formed by selectively removing walls or ribs 86 formed between adjacent pockets 72 and by forming connectors, transitions, or bridges 88 between adjacent posts or projections 74 so as to bridge projections 74. By selectively removing ribs 86 formed between adjacent pockets 72, one or more combined pockets 92 having a new geometrical shape are formed, and by bridging one or more adjacent projections 74, one or more combined projections 94 having the same new geometrical shape as combined pockets 92 are formed. Accordingly, combined pockets 921, 922, and 923 in association with combined projections 941, 942, and 943 form mating keys or key combinations for keying arrangement 70.

For example, with reference to FIGS. 6 and 7, in one embodiment, combined pockets 921 and 922 are formed by removing ribs 863 and 865, respectively, between adjacent pockets 72. As such, mating and corresponding combined projections 941 and 942 are formed by bridging adjacent projections 741 and 743 and by bridging adjacent projections 744 and 746, respectively. As such, a shape of combined projections 941 and 942 is the same as, and corresponds to the shape of combined pockets 921 and 922.

In another embodiment, a combined pocket 923 having a compound geometrical shape is formed by removing multiple ribs adjacent to one pocket 72, for example, by removing two ribs 862 and 863 provided between one pocket and adjacent pockets to the one pocket. As such, a mating and corresponding combined projection 943 having the same compound geometrical shape is formed by bridging projections adjacent to one projection 74, for example, by bridging projection 741 and projections 742 and 743 adjacent to projection 741.

In one embodiment, as illustrated in FIG. 6, pockets 72 and projections 74 have a substantially square shape. More specifically, pockets 72 and projections 74 have a substantially square cross-sectional shape along an axis extending through an opening of pockets 72 and along an axis extending through an end of projections 74 inserted into pockets 72. In one embodiment, pockets 72 and projections 74 are correspondingly tapered to facilitate insertion and removal of projections 74 into and out of pockets 72.

Corresponding to the substantially square shape of pockets 72 and projections 74 of the embodiment of FIG. 6, in one embodiment, as illustrated in FIG. 7, combined pockets 921, 922, and 923 and combined projections 941, 942, and 943 have a substantially rectangular shape (or compound substantially rectangular shape in the case of combined pocket 923 and combined projection 943) when ribs 86 between adjacent pockets 72 are removed and adjacent projections 74 are bridged. More specifically, combined pockets 921, 922, and 923 have a substantially rectangular cross-sectional shape (or compound substantially rectangular cross-sectional shape) along an axis extending through an opening of combined pockets 921, 922, and 923, and along an axis extending through an end of combined projections 941, 942, and 943 inserted into mating and corresponding combined pockets 921, 922, and 923.

Figure 8:
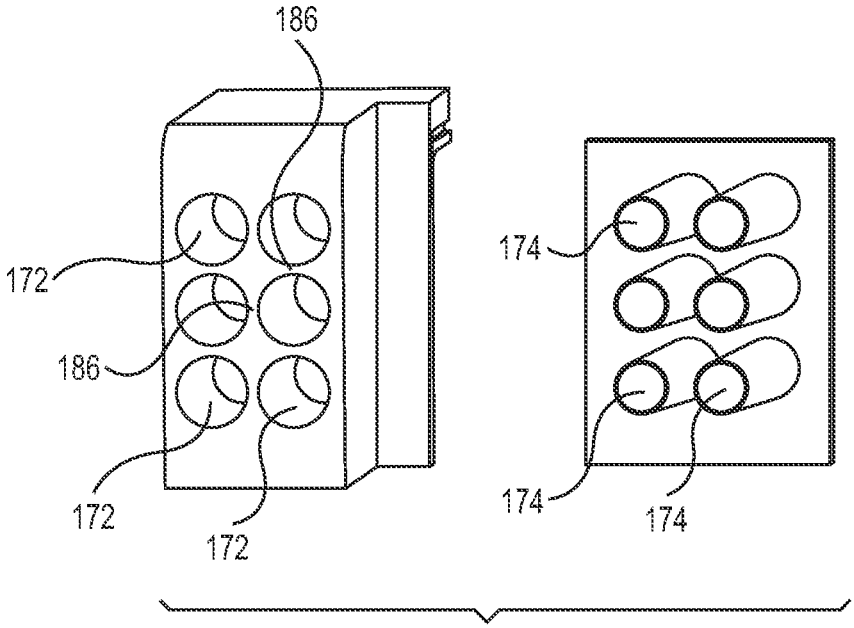
FIGS. 8 and 9 are schematic perspective views illustrating another embodiment of forming a keying arrangement between a carriage and an ink container.

In another embodiment, as illustrated in FIG. 8, pockets 172 and projections 174 have a substantially circular shape. More specifically, pockets 172 and projections 174 have a substantially circular cross-sectional shape along an axis extending through an opening of pockets 172 and along an axis extending through an end of projections 174 inserted into pockets 172. In one embodiment, pockets 172 and projections 174 are correspondingly tapered to facilitate insertion and removal of projections 174 into and out of pockets 172.

Figure 9:
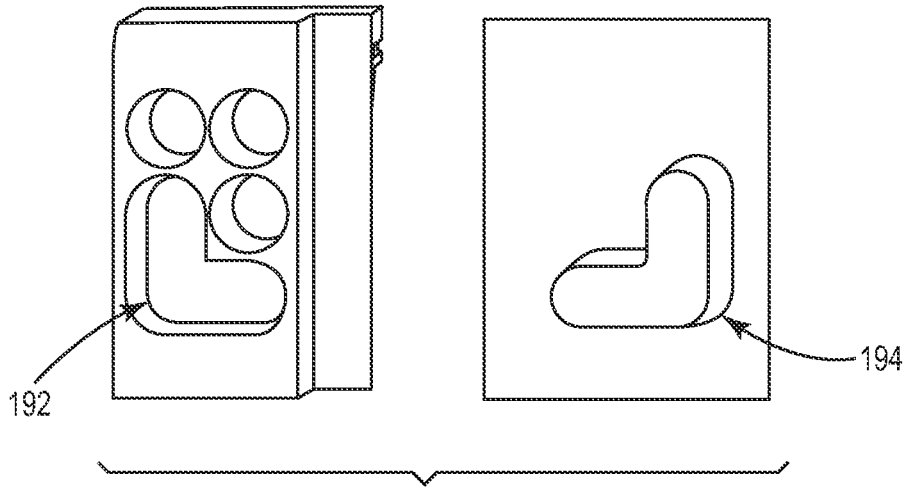

Corresponding to the substantially circular shape of pockets 172 and projections 174 of the embodiment of FIG. 8, in one embodiment, as illustrated in FIG. 9, combined pocket 192 and combined projection 194 have a substantially oval shape (or compound substantially oval shape in the case of combined pocket 192 and combined projection 194) when ribs 186 between adjacent pockets 172 are removed and adjacent projections 174 are bridged. More specifically, combined pocket 192 has a substantially oval cross-sectional shape along an axis extending through an opening of combined pocket 192 and along an axis extending through an end of combined projection 194 inserted into combined pocket 192.

Figure 10:
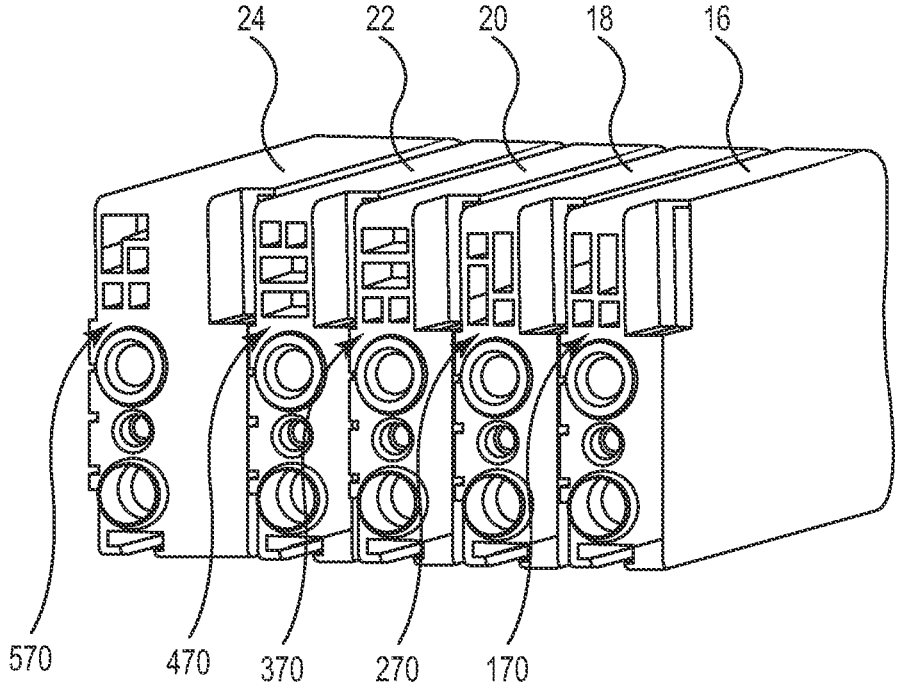
FIGS. 10 and 11 are perspective views illustrating one embodiment of a keying arrangement between a carriage and a plurality of ink containers.
Figure 11:
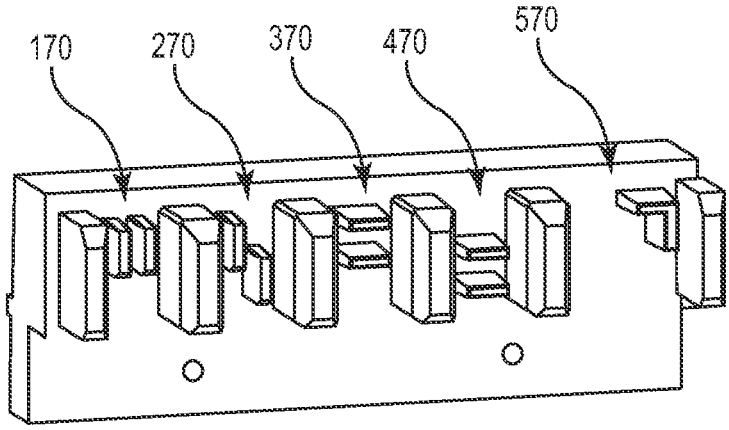

FIGS. 10 and 11 illustrate one embodiment of keying a plurality of ink containers, such as ink containers 16, 18, 20, 22, and 24, to carriage 12 (only a portion thereof being illustrated in FIG. 11) to ensure proper insertion of the ink containers in carriage 12 including, more specifically, the insertion of the ink containers in the proper bays of carriage 12, such as bays 38, 40, 42, 44, and 46, respectively, of carriage 12 (FIG. 2). Accordingly, in one embodiment, a number of different or unique key combinations are established for each of ink containers 16, 18, 20, 22, and 24. For example, in one embodiment, a key combination 170 is established for ink container 16, a key combination 270 is established for ink container 18, a key combination 370 is established for ink container 20, a key combination 470 is established for ink container 22, and a key combination 570 is established for ink container 24. As such, key combinations 170, 270, 370, 470, and 570 ensure that only the intended ink containers 16, 18, 20, 22, and 24, respectively, are inserted in the proper bays of carriage 12.

The number of key combinations available is based on the number of walls or ribs 86, 186 that separate pockets 72, 172 (FIGS. 6 and 8). For example, for X number of columns of pockets and Y number of rows of pockets, the following equations represent the number of key combinations available:

$$Y(X-1)+X(Y-1)=N \qquad \text{Equation 1}$$

where N=the number of walls or ribs available with which to make keys.

As such, for key combinations with two walls or ribs removed between adjacent pockets, the number of key combinations available is expressed as:

$$\sum_{i=1}^{N-1} Z_i \qquad \text{Equation 2}$$

where Z=the number of key combinations available.

For example, for a 2×3 array of pockets, the number of walls or ribs available with which to make keys is calculated as:

$$N=3(2-1)+2(3-1)=3+4=7$$

Accordingly, with two walls or ribs removed between adjacent pockets, the number of key combinations available is calculated as:

$$Z=1+2+3+4+5+6=21$$

Applying the above equations to a 2×2 array of pockets, the number of key combinations available is 6, and for a 3×3 array of pockets, the number of key combinations available is 61. Again, the above equations apply to having two walls or ribs removed between adjacent pockets to create key combinations. Equations for having one wall or three walls removed between adjacent pockets are also possible.

While the Description is at least substantially presented herein to inkjet-printing devices that eject ink onto media, those of ordinary skill within the art can appreciate that embodiments of the present disclosure are more generally not so limited. In general, embodiments of the present disclosure pertain to any type of fluid-jet precision dispensing device or ejector assembly for dispensing a substantially liquid fluid. The fluid-jet precision dispensing device precisely prints or dispenses a substantially liquid fluid in that the latter is not substantially or primarily composed of gases such as air. Examples of such substantially liquid fluids include inks in the case of inkjet printing devices. Other examples of substantially liquid fluids include drugs, cellular products, organisms, chemicals, fuel, and so on, which are not substantially or primarily composed of gases such as air and other types of gases. Therefore, while the Description is described in relation to an inkjet printer and inkjet printhead assembly for ejecting ink onto media, embodiments of the present disclosure more generally pertain to any type of fluid-jet precision dispensing device or fluid ejector structure for dispensing a substantially liquid fluid.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. A printing system, comprising:

a replaceable printing component including an array of pockets separated by ribs and each having a first geometrical shape; and a support structure configured to support the replaceable printing component and including an array of projections each having the first geometrical shape, wherein the pockets are formed in a side of a housing of the replaceable printing component and the projections are formed on a surface of the support structure, and wherein the projections are inserted into the pockets in a direction substantially perpendicular to the surface of the support structure and received by the pockets in a direction substantially perpendicular to the side of the housing, wherein at least one of the ribs between adjacent ones of the pockets is excluded to form a combined pocket having a second geometrical shape, and wherein at least one bridge is formed between adjacent ones of the projections to form a combined projection having the second geometrical shape.

2. The printing system of claim 1, wherein the first geometrical shape includes a square, and the second geometrical shape includes a rectangle.

3. The printing system of claim 1, wherein the first geometrical shape includes a circle, and the second geometrical shape includes an oval.

4. The printing system of claim 1, wherein two ribs between one pocket and adjacent ones of the pockets to the one pocket are excluded to form the combined pocket having the second geometrical shape, and wherein two bridges are formed between one projection and adjacent ones of the projections to the one projection to form the combined projection having the second geometrical shape.

5. The printing system of claim 1, wherein the pockets of the replaceable printing component are open only to the side of the housing.

6. The printing system of claim 1, wherein the array of pockets comprises at least a 2×2 array of adjacent pockets, and wherein the array of projections comprises at least a 2×2 array of adjacent projections.

7. The printing system of claim 1, wherein the pockets each extend a first depth into the side of the housing, and wherein the projections each project a first distance from the surface of the support structure.

8. The printing system of claim 1, wherein the replaceable printing component further includes a datum feature provided within at least one of the pockets or the combined pocket to locate the replaceable printing component in the support structure.

9. The printing system of claim 1, wherein the replaceable printing component further includes an alignment feature provided on the side of the housing to position the replaceable printing component in the support structure.

10. The printing system of claim 1, wherein the replaceable printing component comprises a printing fluid container, and further includes a fluid interconnect provided on the side of the housing to fluidically connect the replaceable printing component in the printing system.

11. A method of keying a replaceable printing component with a support structure, the method comprising:

forming at least one combined pocket having a second geometrical shape in a side of a housing of the replaceable printing component, the forming including excluding at least one rib separating adjacent pockets of an array of pockets in the replaceable printing component each having a first geometrical shape;

forming at least one combined projection having the second geometrical shape on a surface of the support structure, the forming including bridging adjacent projections of an array of projections of the support structure each having the first geometrical shape; and positioning the replaceable printing component in the support structure, the positioning including inserting the at least one combined projection in the at least one combined pocket in a direction substantially perpendicular to the surface of the support structure and receiving the at least one combined projection in the at least one combined pocket in a direction substantially perpendicular to the side of the housing to mate the at least one combined projection of the support structure with the at least one combined pocket of the replaceable printing component.

12. The method of claim 11, wherein the pockets each extend a first depth into the side of the housing, and wherein the projections each project a first distance from the surface of the support structure.

* * * * *